US005135146A

United States Patent [19]

Simhaee

[11] Patent Number: 5,135,146

[45] Date of Patent: Aug. 4, 1992

[54] PLASTIC BAG DISPENSER

[76] Inventor: Ebrahim Simhaee, 112 N. Maple Dr., Beverly Hills, Calif. 90210

[21] Appl. No.: 652,031

[22] Filed: Feb. 7, 1991

[51] Int. Cl.[5] ..... B26F 3/02; B65D 85/671

[52] U.S. Cl. ..... 225/80; 225/85; 225/90; 225/91; 225/106

[58] Field of Search ..... 225/47, 51, 77, 80, 225/85, 90, 106, 91; 242/55.3

[56] References Cited

U.S. PATENT DOCUMENTS

| | | | |
|---|---|---|---|
| 751,920 | 2/1904 | Jones | 225/90 |
| 943,279 | 12/1909 | Smith | 225/47 |
| 1,704,044 | 3/1929 | Ingram . | |
| 1,912,363 | 6/1933 | De Waide . | |
| 2,349,635 | 5/1944 | Pusheck | 225/85 |
| 3,098,594 | 7/1963 | Williamson | 225/48 |
| 3,229,876 | 1/1966 | Osborn, Jr. | 225/49 |
| 3,281,089 | 10/1966 | Krueger et al. | 242/55.3 |
| 4,179,055 | 12/1979 | Milner | 225/91 |
| 4,714,191 | 12/1987 | Richardson | 229/121 |

FOREIGN PATENT DOCUMENTS

| | | | |
|---|---|---|---|
| 413664 | 8/1910 | France | 225/80 |
| 392805 | 10/1965 | Switzerland | 225/47 |
| 2088330 | 6/1982 | United Kingdom | 225/106 |

*Primary Examiner*—Hien H. Phan
*Attorney, Agent, or Firm*—Darby & Darby

[57] ABSTRACT

A plastic bag dispenser holds a continuous roll of bags, connected by perforated separation lines. The dispenser is provided with a tongue, which the bags are dispensed over, that engages the separation line between the bag at the end of the roll and the next bag. This begins the separation of the separation line, as well as holds the next bag behind the tongue. A finger is provided on the upstream side of the tongue, with a gap between the finger and tongue. As a bag is separated, a portion of the front edge of the next bag is held in the gap, holding the bag in position for the next user.

12 Claims, 2 Drawing Sheets

PLASTIC BAG DISPENSER

FIELD OF THE INVENTION

This invention relates to devices for dispensing a continuous web of articles. Specifically, the invention relates to plastic bag dispensers, such as the type used for self-service produce, grocery, or garbage bags.

BACKGROUND OF THE INVENTION

In a supermarket or food market, fruits and vegetables are often displayed in bulk, possibly in piles of loose items. Consumers must then take a bag from a nearby source and pick and bag their own produce. The most common form of these produce bags are cylindrical rolls of plastic bags, mounted horizontally or vertically on a shaft. The bags have perforated separation lines between them. Separation is accomplished by grabbing the end bag with one hand, anchoring the next bag or the roll with the other hand, and pulling. Unfortunately, this not only separates the bag from the roll, but can deform or even tear the bag. Sometimes, consumers will attempt to simply jerk the bag from the roll, without holding the adjacent bag. This, too, can damage the bag or simply reel out the roll. After any bag separation, the end of the next bag can be difficult to find or grab as it may lie flat on the surface of the roll.

It is thus an object of the invention to provide an improved dispenser for a continuous web of articles.

It is a further object of the invention to provide a dispenser with improved means for easily separating articles from a continuous web with one-handed operation and retaining the next article in an easily accessible position.

It is a further object of the invention to provide an improved means for preventing free-wheeling of the continuous web during dispensing.

It is a further object of the invention that the dispenser be economical and simple to manufacture.

SUMMARY OF THE INVENTION

In accordance with the objects of the invention, a plastic bag dispenser holds a continuous roll of bags, connected by perforated separation lines. The dispenser is provided with a tongue, which the bags are dispensed over, that engages the separation line between the bag at the end of the roll and the next bag. This begins the separation of the separation line, as well as holds the next bag behind the tongue. A finger is provided on the upstream side of the tongue, with a gap between the finger and tongue. As a bag is separated, a portion of the front edge of the next bag is held in the gap, holding the bag in position for the next user.

BRIEF DESCRIPTION OF THE DRAWINGS

The foregoing and other objects and advantages of this invention will become apparent to those skilled in the art upon reading the detailed description of a preferred embodiment in conjunction with a review of the appended drawings in which.

DETAILED DESCRIPTION OF THE INVENTION

Figure 1:
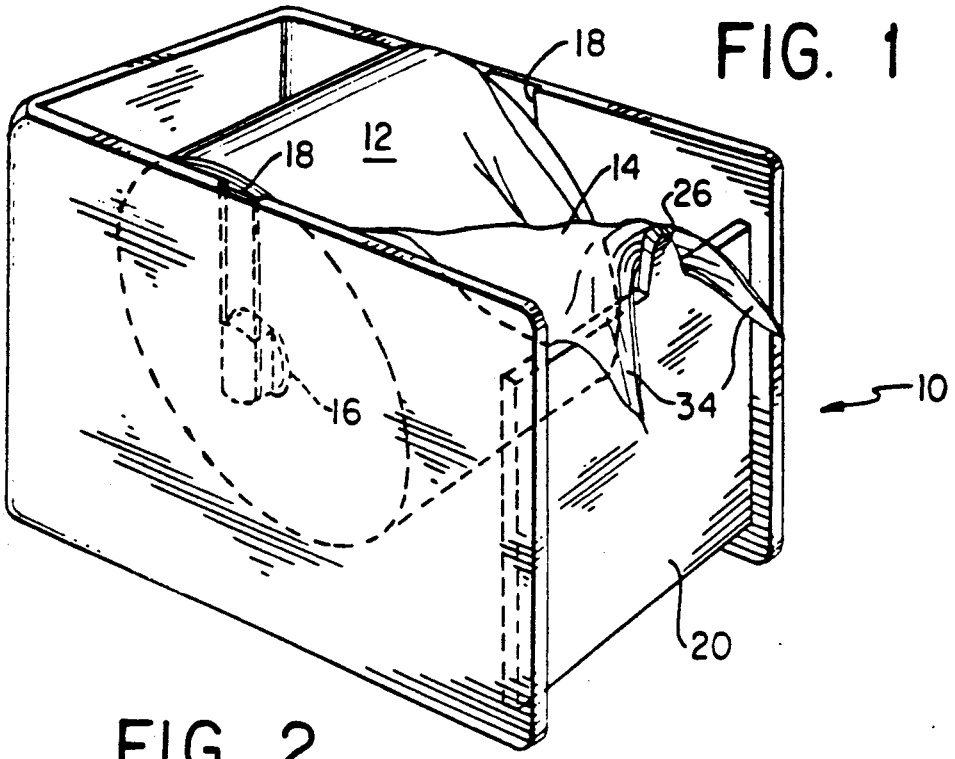
FIG. 1 is a perspective view of the invention, after a bag has been separated and removed.

A dispenser includes a generally rectangular box 10 for housing a continuous roll of articles 12. Individual articles 14 may be sheets of plastic, preferably pre-fabricated into sealed bag-like containers disposed in a unitary end-to-end relationship. The top of the box 10 is open for quick replacement of the roll 12, which rotates on an axle 16. The two ends of the axle 16 rest in two grooves 18 cut into the interior faces of the side walls of the box 10. The grooves 18 extend to the top of the side walls, where the axle 16 is inserted. One end of the axle 16 preferably has notches 19 and the corresponding groove 18 is narrowed to prevent rotation of the axle 16 during rotation of the roll 12. One end wall 20 has a lower top surface than the other three walls. The bags 14 are dispensed over the top surface of the end wall 20.

Each bag 14 is sealed at one end and connected to adjacent bags by a perforated separation line 22. At the center of the separation line 22 is a slot 24, although the slot 24 can be placed at other positions on the separation line 22. Integrally molded with the end wall 20 and extending upward beyond the wall 20 is a tongue 26. The tongue 26 is positioned at the center of the top surface of the wall 20 to receive the slot 24. The tongue 26 preferably has a half-oval shape with its top surface angled upward, the higher side being toward the inside of the box 10.

Either integrally molded with or preferably attached to the interior surface of the end wall 20, adjacent the tongue 26, is a finger 28 that extends inwardly from the wall 20. The upper limit of the finger 28 is below the top of the tongue 26, but above the upper surface of the end wall 20. The top of the finger 28 is preferably rounded convexly in the direction of travel of bags 14 to facilitate the movement of bags over the finger 28. Between the upper portions of the tongue 26 and finger 28 is a V-shaped gap 30, perpendicular to the direction of travel of the bags 14, which receives the leading edge of an upstream bag after a slot 24 between two bags 14 has been engaged by the tongue 26.

Figure 2:
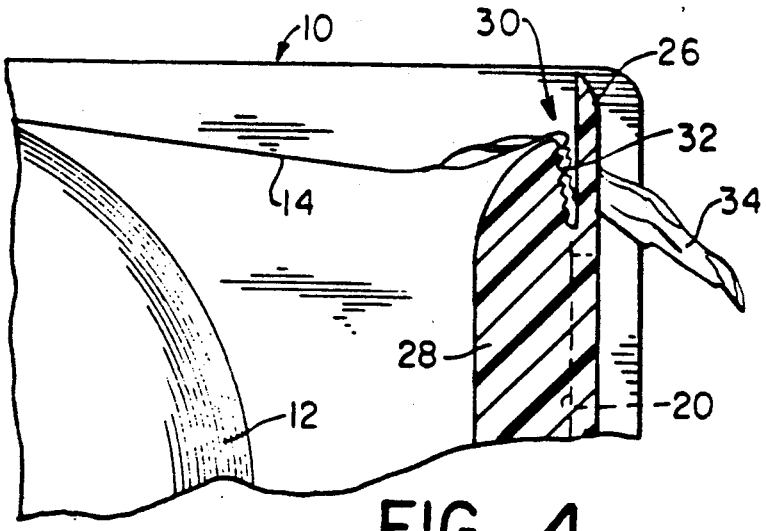
FIG. 2 is a side cross-section of the tongue/finger assembly, showing the next bag partially inserted in the gap.
Figure 3:
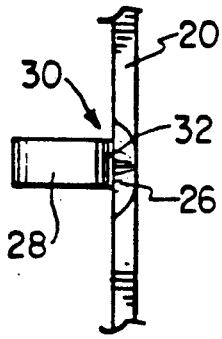
FIG. 3 is a top view of the tongue/finger assembly.
Figure 4:
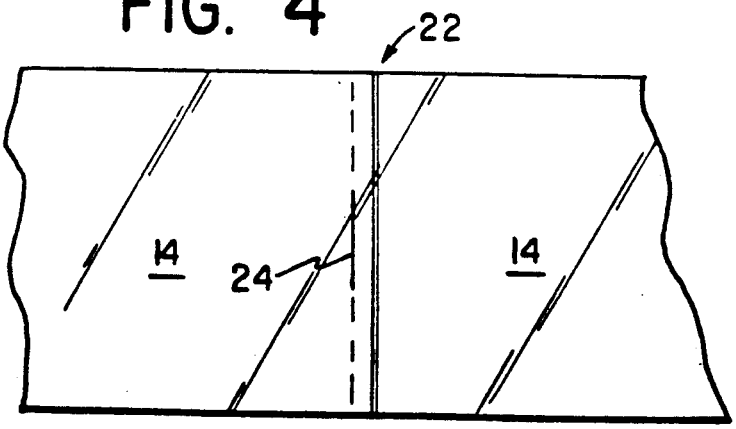
FIG. 4 is a detail of the separation line between two adjacent bags on the continuous roll.

Within the gap 30 are means 32 to impede but not prohibit the upward movement of a portion of a bag 14 out of the gap 30, while not impeding downward movement into the gap. This means is preferably a set of downwardly-angled horizontal teeth 32 on the surface of the finger 28 within the gap 30, as shown in FIG. 2.

In practice, a consumer would find the dispenser in a condition as in FIG. 1, with a portion of a leading edge of an end bag 34 within the gap 30 and the two leading corners of the end bag 34 extending forward past the end wall 20. The consumer grabs the portion of the end bag 34 extending forward of the end wall and pulls it upward and forward, away from the roll 12, extricating the bag 34 from the gap 30. The teeth 32 are designed so that only minimum force is required to extricate the bag 34 from the gap 30, avoiding damage to the bag. While pulling the end bag 34 away from the roll 12, the consumer pulls the bag 34 over the tongue 26 and then at an angle below horizontal, preferably to below the level of the bottom of the gap 30, so that the tongue will contact the underside of the bag 34 as the bag travels. Eventually, the tongue 26 will engage the slot 24 at the trailing end of the end bag 34, splitting the slot 24 over the tongue 26. The center of the leading edge of the next bag will then travel down into the gap 30 and remain there.

Further forward motion of the end bag 34, in response to force by the consumer will result in the ends of the separation line 22 bending forward around the tongue 26. The separation line 22 will then separate starting at the slot 24 and progressing outward toward both ends of the line 22. After complete separation and removal of the end bag 34, the dispenser will again be as in FIG. 1, with a new end bag ready for the next consumer. Because of the downward-facing teeth 32 in the gap, the bag 34 will tend to remain in the gap 30 until such time as a consumer pulls upward on the leading edge. The dispenser will thus constantly be in a ready state, until the roll of bags 12 is depleted.

Figure 5:
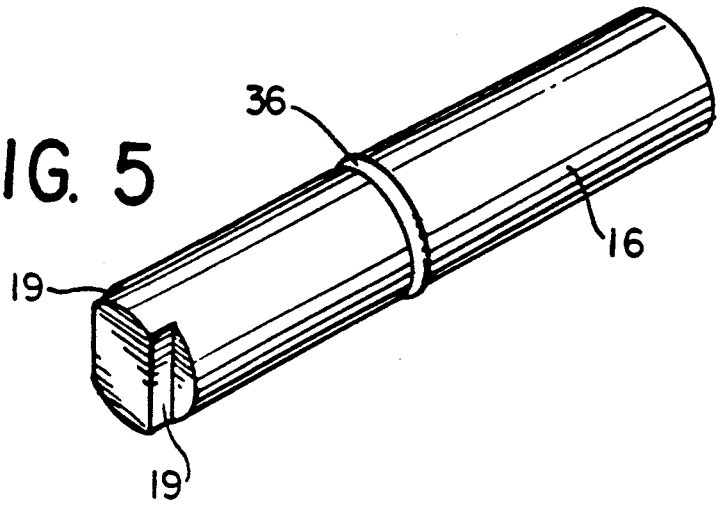
FIG. 5 is a perspective view of the axle.
Figure 6:
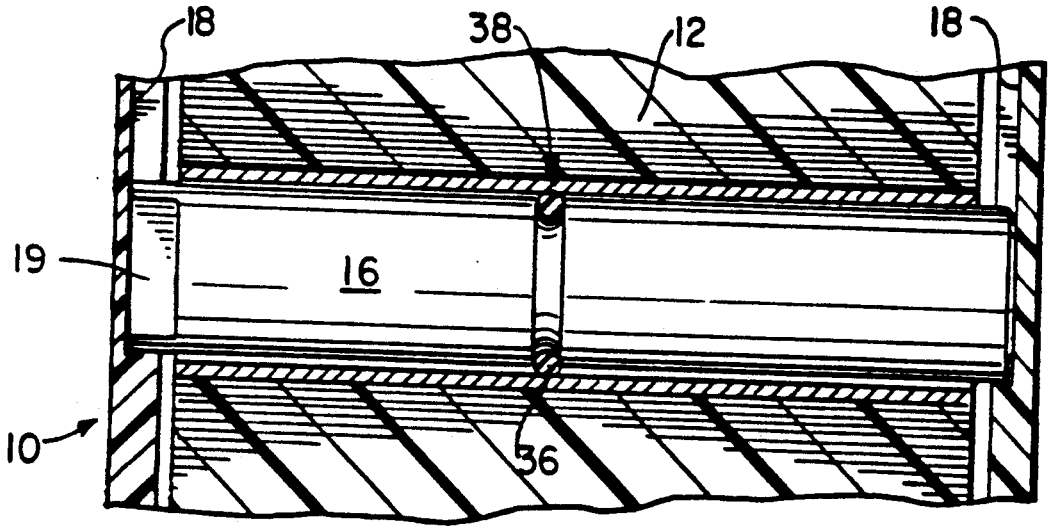
FIG. 6 is a partial cross-section of the invention, showing the axle and the O-ring.

When a consumer pulls on the end bag 34, a significant amount of rotational momentum is gained by the roll 12. To prevent the roll 12 from free-wheeling and reeling out several bags as the end bag 34 is dispensed, the axle 16 with notches 19 is preferably provided with a rubber O-ring 38, as in FIG. 5, that frictionally engages the roll 12. Other materials besides rubber will work similarly. In known devices, an O-ring is slipped onto the axle, and over time tends to slip off one of the ends. To prevent axial movement of the O-ring 38 on the axle 16, the axle 16 is provided with a circumferential groove 36, in which the O-ring 38 rests. The groove 36 is dimensioned so that a portion of the O-ring 38 will extend beyond the outer surface of the axle 16.

The construction of the dispenser allows for simple mounting to any surface, be it horizontal, vertical or otherwise, by conventional means, such as with screws or glue. It also can be free standing, with one hand holding the box 10, if necessary, while the other pulls the end bag 34. The dispenser may also be formed of a light-transmissive material to give the owner of the dispenser ample warning that a roll 12 is nearly depleted.

While the embodiment of the invention shown and described is fully capable of achieving the results desired, it is to be understood that this embodiment has been shown and described for purposes of illustration only and not for purposes of limitation.

What is claimed is:

1. A separator for separating an article from a continuous web of articles having separation lines between said articles, comprising:

a tongue extending upwardly for engaging a slot in said separation lines between said articles during separation; and an upwardly extending finger positioned adjacent and upstream of said tongue and spaced from said tongue to define a gap therebetween, said gap positioned to receive a portion of a second article adjacent said article to be separated and retain said portion as said article to be separated is separated from the continuous web of articles, said gap being adapted to allow said portion to depart from said gap only in the direction from which it was received.

2. Apparatus according to claim 1 wherein said continuous web of articles is comprised of a cylindrical roll of articles.

3. Apparatus according to claim 1 wherein said tongue and said finger are joined at one end of the gap, such that the cross-section of said gap is an acute angle.

4. Apparatus according to claim 3 wherein at least one of said fingers and said tongue is provided with means for impeding movement of said second article out of said gap.

5. Apparatus according to claim 4 wherein said means for impeding comprises at least one angled projection, said projection projecting into said gap.

6. Apparatus according to claim 5 wherein said at least one projection is angled toward said one end of said gap.

7. Apparatus according to claim 4 wherein said means for impeding allows free movement of said second article into said gap.

8. A dispenser for dispensing and separating an article from a continuous web of articles having separation lines between said articles, comprising:

a container for holding said continuous web;

a tongue attached to said container and extending upwardly for engaging a slot in said separation lines between said articles during separation; and an upwardly extending finger attached to said container and positioned adjacent and upstream of said tongue and spaced from said tongue to define a gap therebetween, said gap positioned to receive a portion of a second article adjacent said article to be separated and retain said portion as said article to be separated is separated from the continuous web of articles, said gap being adapted to allow said portion to depart from said gap only in the direction from which it was received.

9. Apparatus according to claim 8 wherein said continuous web of articles comprises a cylindrical roll of articles.

10. Apparatus according to claim 9, further comprising an axle mounted in said container for rotatably suspending said roll of articles, said axle further comprising means for impeding rotation of said roll and means for preventing axial movement of said means for impeding rotation.

11. Apparatus according to claim 10 wherein said means for impeding rotation of said roll comprises an O-ring and said means for preventing axial movement comprises a groove in which said O-ring rests.

12. Apparatus according to claim 8 wherein said container is formed of a light-transmissive material, allowing said continuous web to be seen from outside said container.

* * * * *